US010228177B2

(12) United States Patent
Hwang

(10) Patent No.: US 10,228,177 B2
(45) **Date of Patent: *Mar. 12, 2019**

(54) ICE MAKING SYSTEM

(71) Applicant: LG ELECTRONICS INC., Seoul (KR)

(72) Inventor: Gue-Sec Hwang, Changwon (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/912,195

(22) Filed: Mar. 5, 2018

(65) Prior Publication Data

US 2018/0195785 A1 Jul. 12, 2018

Related U.S. Application Data

(63) Continuation of application No. 15/465,362, filed on Mar. 21, 2017, now Pat. No. 10,047,997, which is a (Continued)

(30) Foreign Application Priority Data

Oct. 31, 2007 (KR) ..... 10-2007-0110589

(51) Int. Cl.
*F25C 5/04* (2006.01)
*F25D 23/04* (2006.01)
(Continued)

(52) U.S. Cl.
CPC ..... *F25C 5/046* (2013.01); *F25C 5/02* (2013.01); *F25C 5/18* (2013.01); *F25C 5/22* (2018.01);
(Continued)

(58) Field of Classification Search
CPC ..... F25C 5/005; F25C 5/046; F25D 23/04; F25D 23/12; F25D 2317/061; F25D 2317/0665; F25D 2317/062
(Continued)

(56) References Cited

U.S. PATENT DOCUMENTS 4,176,527 A 12/1979 Linstromberg et al.
4,627,556 A 12/1986 Brooks
(Continued)

FOREIGN PATENT DOCUMENTS

EP 1 705 438 A2 9/2006
JP 6-147742 A 5/1994
(Continued)

*Primary Examiner* — Andrew M Roersma
(74) *Attorney, Agent, or Firm* — Birch, Stewart, Kolasch & Birch, LLP

(57) ABSTRACT

An ice making system for a refrigerator, comprises: a base member; an icemaker mounted to a front surface of the base member for making ice pieces; a driving unit mounted to a rear surface of the base member such that a motor shaft thereof is in a horizontal state; an ice bank horizontally inserted into the base member in a detachable manner, for storing the ice pieces made by the icemaker; a detachable mounting unit for detachably mounting the ice bank to the base member; and an ice crusher assembly provided at the ice bank so as to be connected to or separated from the driving unit, for crushing the ice pieces. Since the ice bank has only to be horizontally pushed into the base member for coupling, or horizontally pulled out of the base member for separation, processes for coupling or separating the ice bank to/from the base member are facilitated. This prevents the ice pieces stored in the ice bank from being discharged out of the ice bank.

8 Claims, 12 Drawing Sheets

Related U.S. Application Data continuation of application No. 14/802,644, filed on Jul. 17, 2015, now Pat. No. 9,638,450, which is a continuation of application No. 12/740,267, filed as application No. PCT/KR2008/004956 on Aug. 25, 2008, now Pat. No. 9,103,577.

(51) Int. Cl.
*F25C 5/02* (2006.01)
*F25C 5/18* (2018.01)
*F25C 5/20* (2018.01)

(52) U.S. Cl.
CPC ..... *F25D 23/04* (2013.01); *F25C 2400/10* (2013.01); *F25D 2317/061* (2013.01)

(58) Field of Classification Search
USPC ..... 62/377, 337, 344
See application file for complete search history.

(56) References Cited

U.S. PATENT DOCUMENTS

| | | | |
|---|---|---|---|
| 4,800,935 | A | 1/1989 | Buchser et al. |
| 4,942,979 | A | 7/1990 | Linstromberg et al. |
| 5,037,004 | A | 8/1991 | Katz et al. |
| 5,056,688 | A | 10/1991 | Goetz et al. |
| 5,211,462 | A | 5/1993 | Bien et al. |
| 5,273,219 | A | 12/1993 | Beach, Jr. et al. |
| 5,855,424 | A | 1/1999 | Hamilton et al. |
| 6,082,130 | A | 7/2000 | Pastryk et al. |
| 6,655,166 | B1 | 12/2003 | Williams |
| 6,973,802 | B1 | 12/2005 | Seo et al. |
| 7,017,363 | B2 | 3/2006 | Lee et al. |
| 7,111,473 | B2 | 9/2006 | Chung et al. |
| 7,159,406 | B2 | 1/2007 | Schuchart |
| 7,743,622 | B2 | 6/2010 | Fischer et al. |
| 9,103,577 | B2 * | 8/2015 | Hwang ..... F25C 5/005 |
| 9,638,450 | B2 * | 5/2017 | Hwang ..... F25C 5/02 |
| 2003/0066825 | A1 | 4/2003 | Leutner et al. |
| 2004/0163405 | A1 | 8/2004 | Jung |
| 2005/0044874 | A1 | 3/2005 | Lee et al. |
| 2005/0132739 | A1 | 6/2005 | Sannasi et al. |
| 2006/0059939 | A1 | 3/2006 | An et al. |
| 2006/0086130 | A1 | 4/2006 | Anselmino et al. |
| 2006/0097610 | A1 | 5/2006 | Lee et al. |
| 2007/0113578 | A1 | 5/2007 | Wu et al. |
| 2008/0295536 | A1 | 12/2008 | Kim et al. |
| 2009/0064703 | A1 | 3/2009 | Kim et al. |
| 2017/0191726 | A1 * | 7/2017 | Hwang ..... F25C 5/046 |

FOREIGN PATENT DOCUMENTS

| | | | |
|---|---|---|---|
| JP | 2001-116410 | A | 4/2001 |
| KR | 10-2005-0021066 | A | 3/2005 |
| KR | 10-2006-0074189 | A | 7/2006 |
| KR | 10-2006-0096533 | A | 9/2006 |
| KR | 10-0640234 | B1 | 10/2006 |
| KR | 10-2007-0103243 | A | 10/2007 |
| WO | WO 2007/066958 | A1 | 6/2007 |
| WO | WO 2007/094554 | A1 | 8/2007 |
| WO | WO 2007/108662 | A1 | 9/2007 |
| WO | WO 2007/120015 | A1 | 10/2007 |
| WO | WO 2008/147045 | A1 | 12/2008 |

* cited by examiner

Prior Art
[Fig. 1]
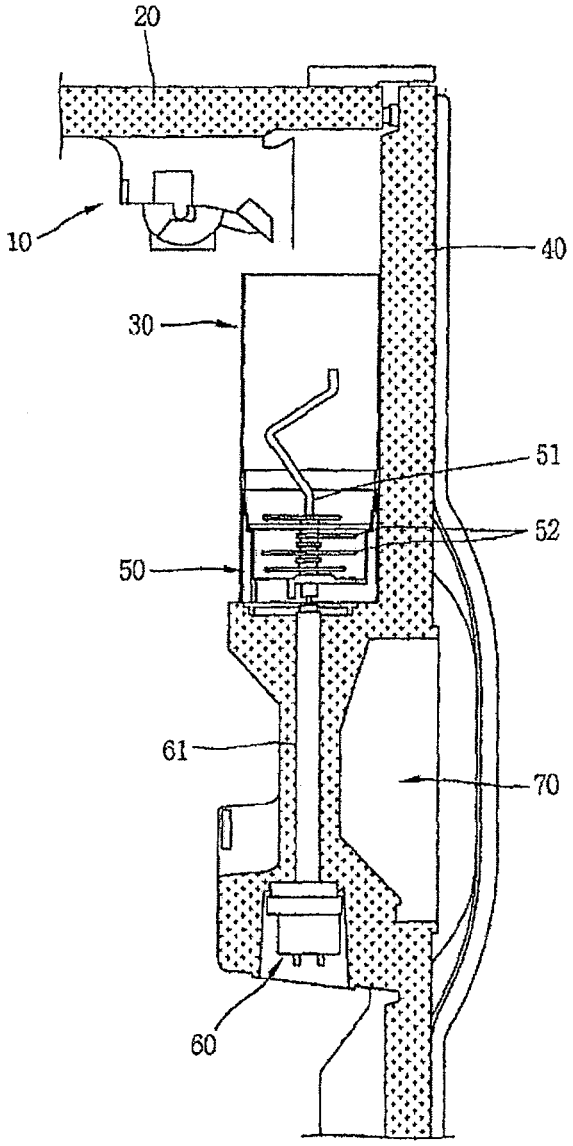

Prior Art
[Fig. 2]
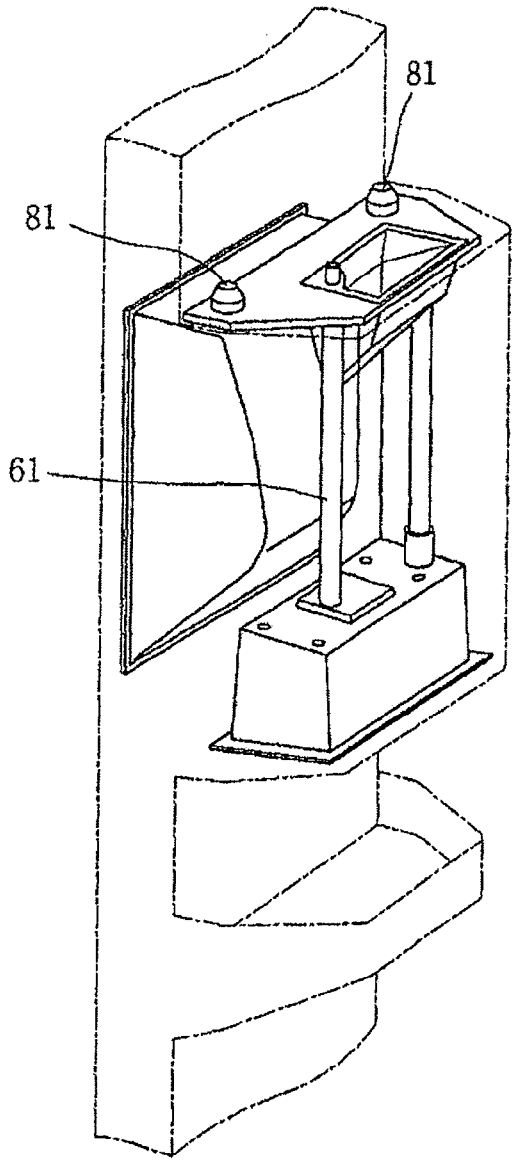

Prior Art
[Fig. 3]
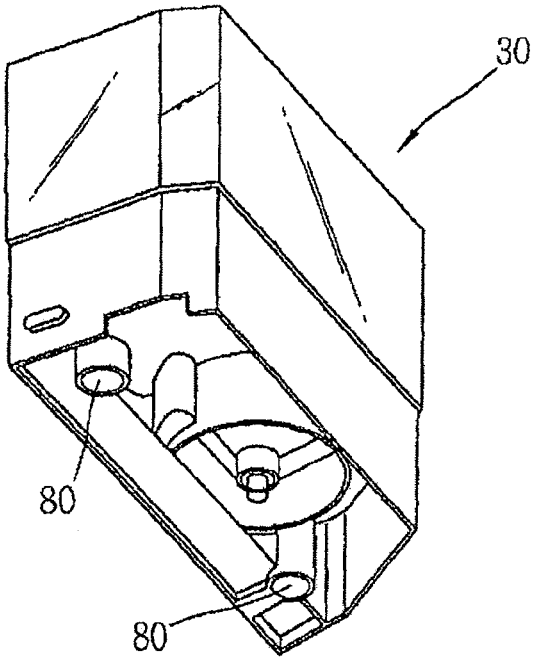

[Fig. 4]
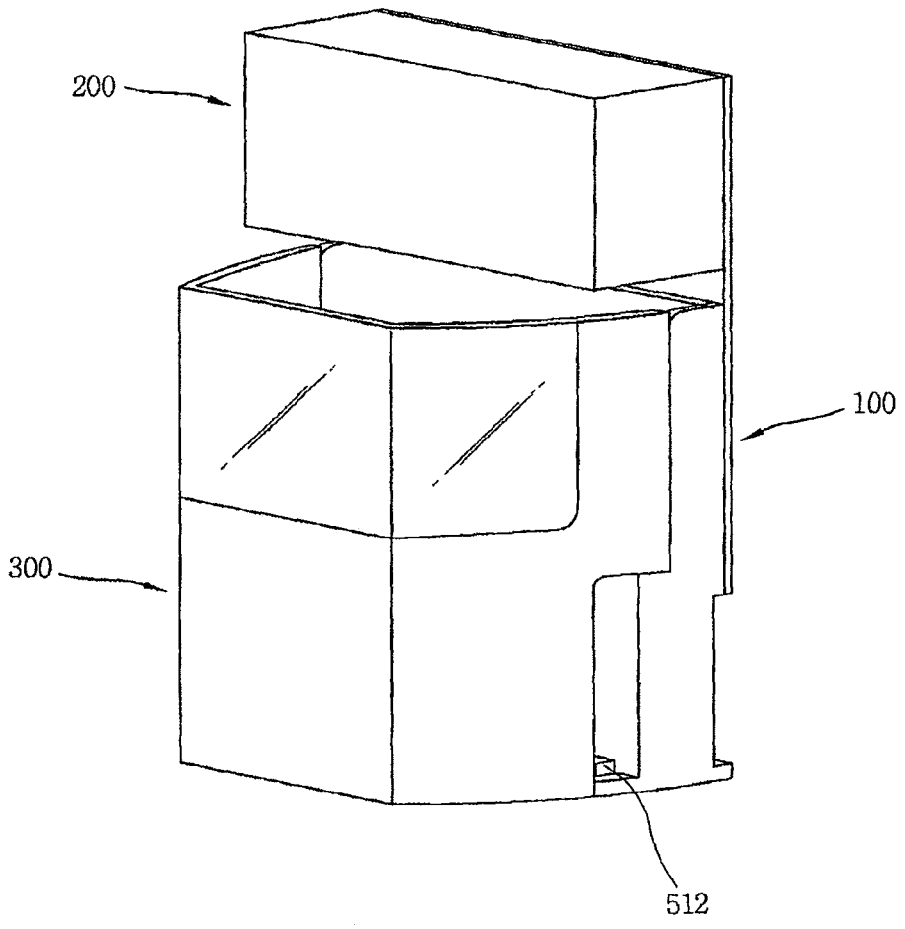

[Fig. 5]
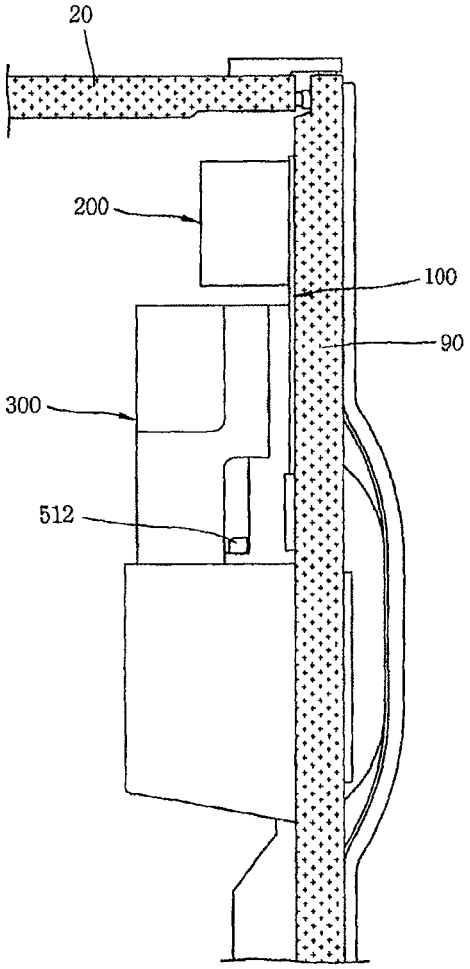

[Fig. 6]
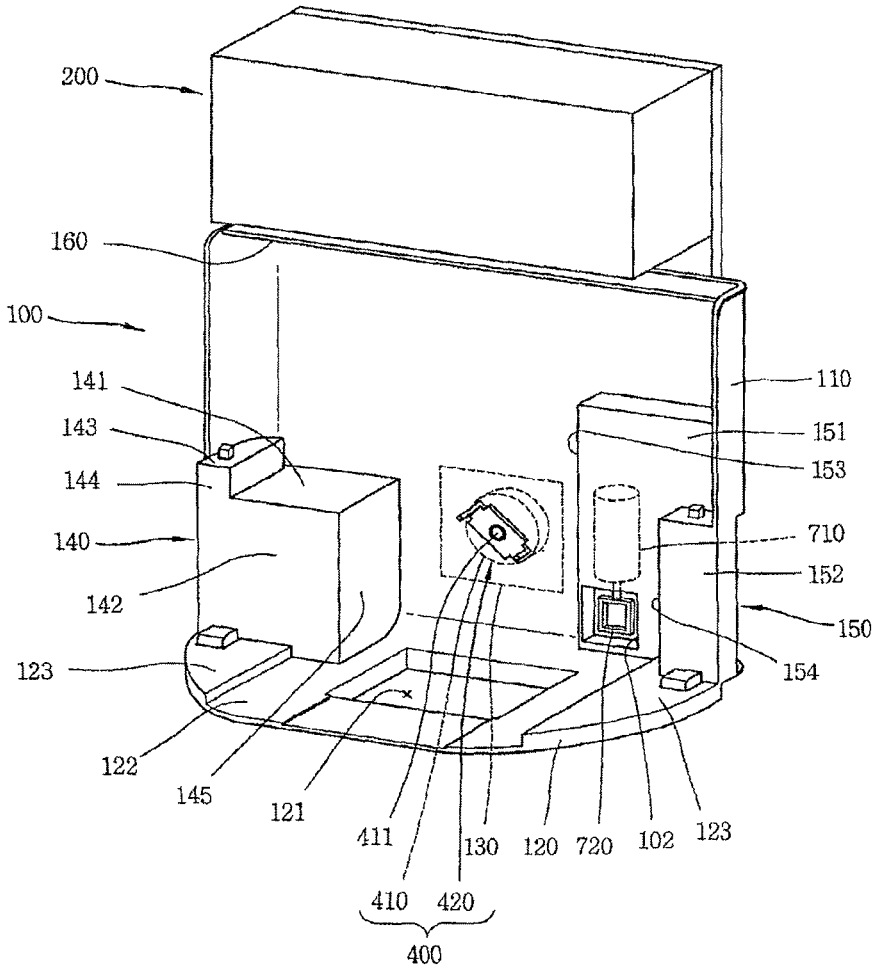

[Fig. 7]
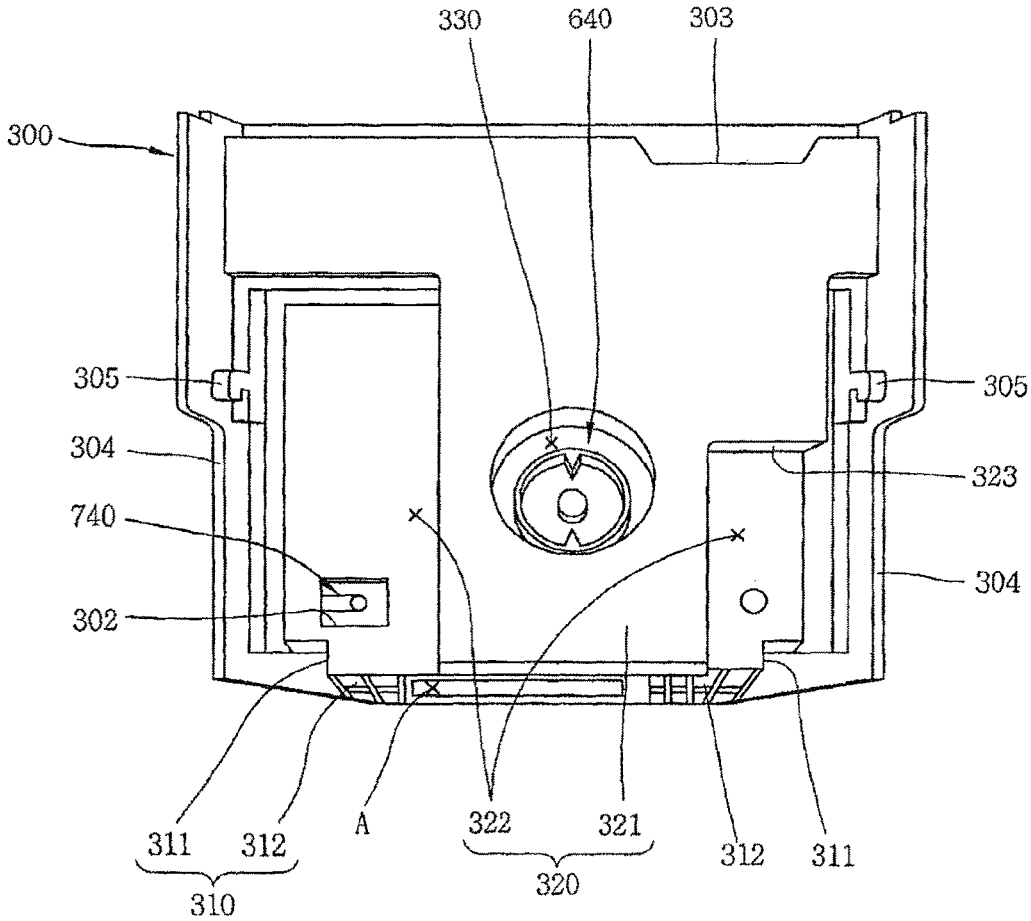

[Fig. 8]
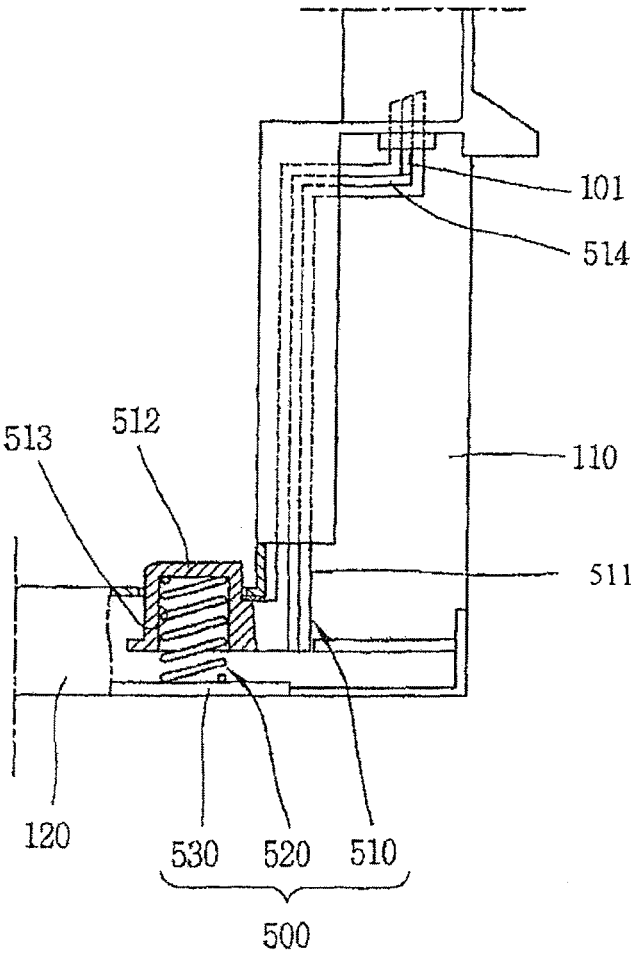

[Fig. 9]
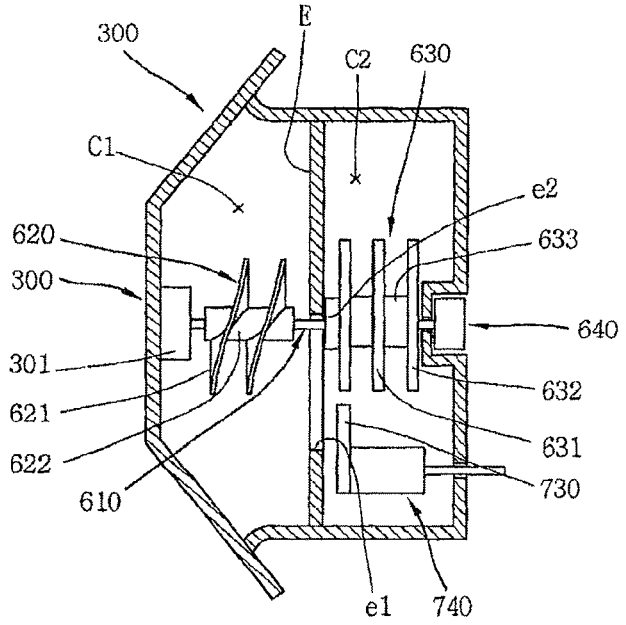

[Fig. 10]
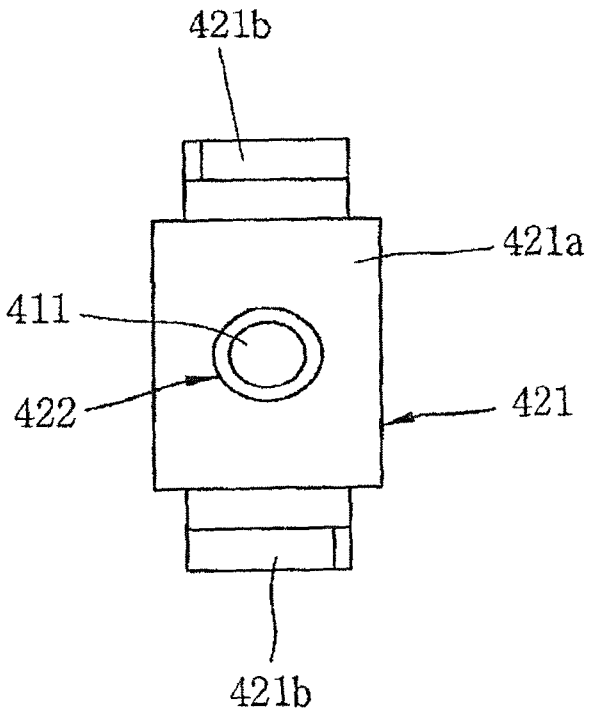
[Fig. 11]
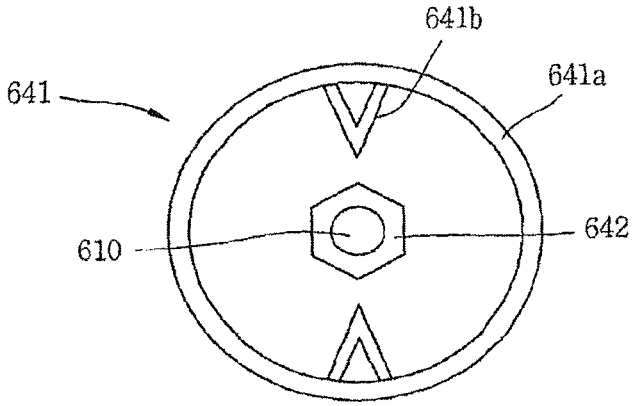

[Fig. 12]
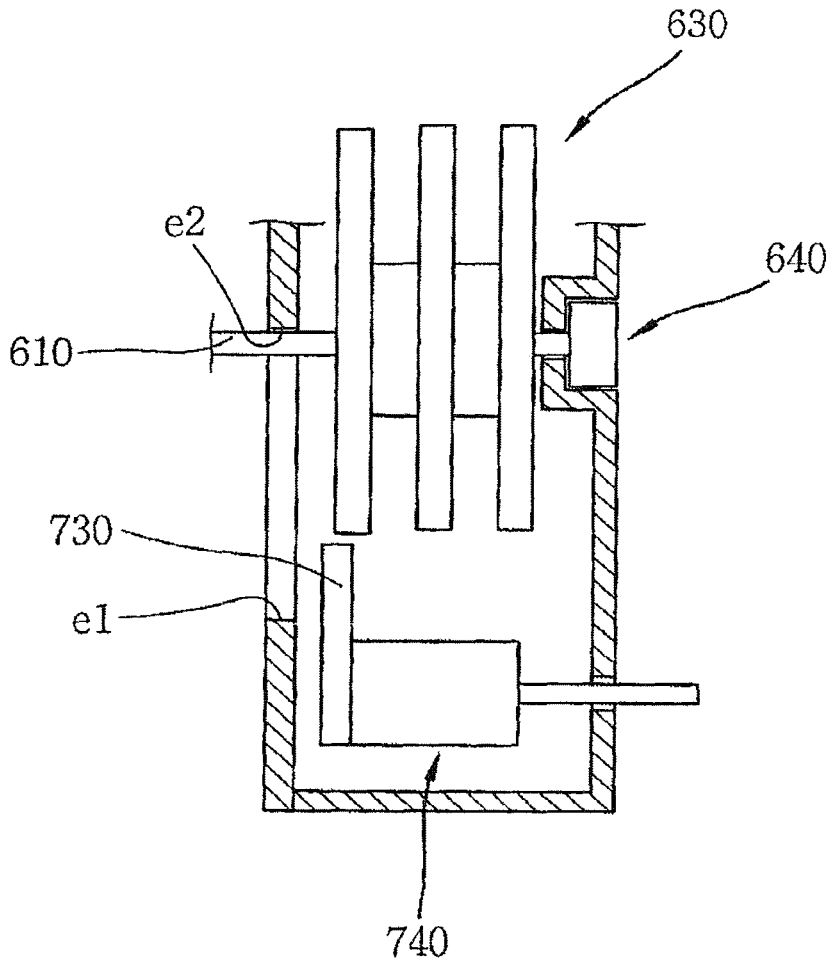

[Fig. 13]
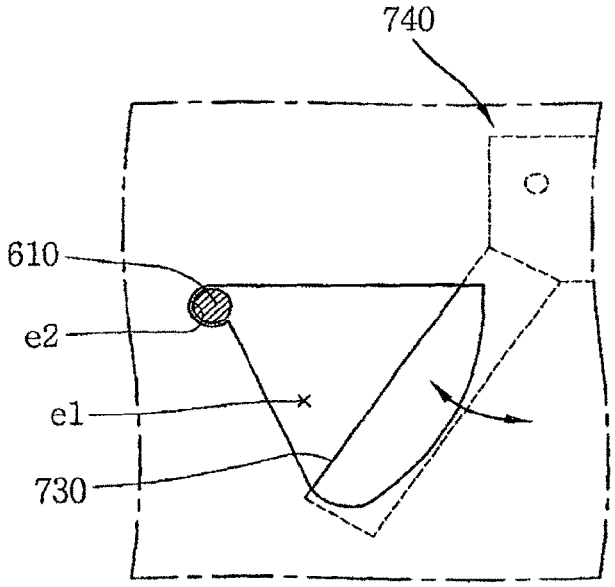
[Fig. 14]
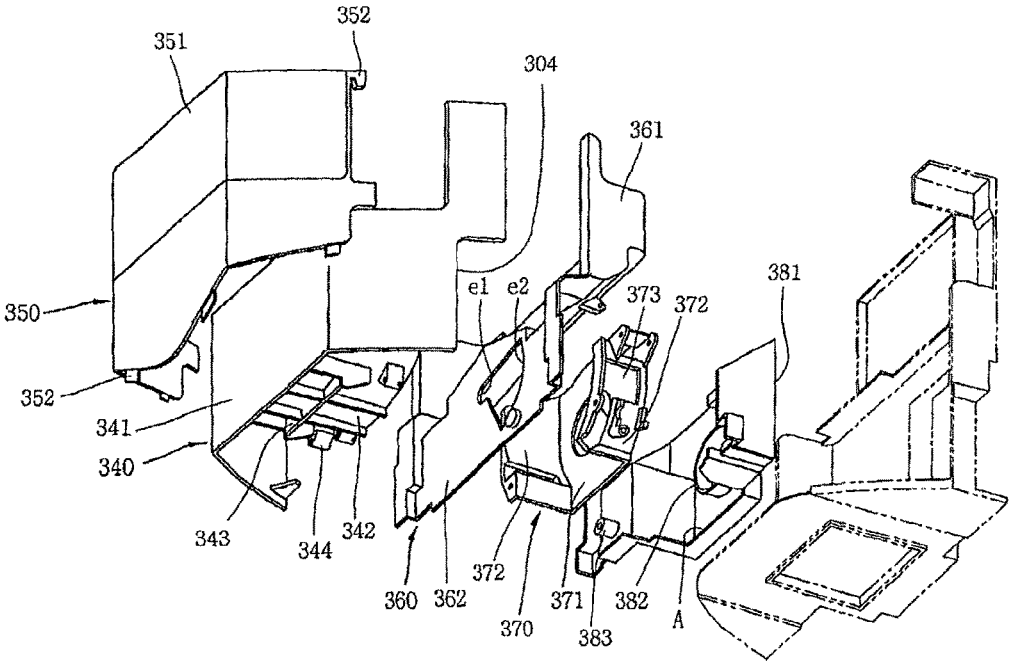

ICE MAKING SYSTEM

CROSS-REFERENCE TO RELATED APPLICATIONS

This application is a Continuation of copending U.S. application Ser. No. 15/465,362, filed Mar. 21, 2017, which is a Continuation of U.S. application Ser. No. 14/802,644, filed Jul. 17, 2015 (Now U.S. Pat. No. 9,638,450, Issued on May 2, 2017), which is a Continuation of U.S. application Ser. No. 12/740,267, filed on Apr. 28, 2010 (Now U.S. Pat. No. 9,103,577, Issued on Aug. 11, 2015), which is a National Stage Application of International Patent Application No. PCT/KR2008/004956, filed on Aug. 25, 2008, which claims the benefit of Korean Patent Application No. 10-2007-0110589, filed on Oct. 31, 2007, all of which are hereby expressly incorporated by reference into the present application.

BACKGROUND

Field of the Invention

The present invention relates to an ice making system, and more particularly, to an ice making system for a refrigerator capable of facilitating detachment of an ice bank that stores ice pieces, capable of preventing the ice pieces stored in the ice bank from pouring when detaching the ice bank, and capable of enhancing a spatial utilization degree of a freezing chamber where ice pieces are made.

Description of the Related Art

Generally, a refrigerator serves to freshly store food items such as meat, fish, vegetable, fruits, and beverages. This refrigerator includes a refrigerator body having a freezing chamber, a refrigerating chamber, a vegetable chamber, etc., and doors mounted to one side of the refrigerator body for opening and closing the freezing chamber and the refrigerating chamber.

The refrigerator body includes a refrigeration cycle apparatus composed of a compressor, a condenser, a capillary tube, an evaporator, etc., a blower for forcibly flowing cool air formed by the evaporator, a circulation passage for guiding the cool air formed by the evaporator to be introduced into the evaporator via the freezing chamber and the refrigerating chamber, etc.

Once a temperature of the freezing chamber or the refrigerating chamber is more than a preset temperature, the refrigerating cycle apparatus starts to operate. As a result, the evaporator starts to form cool air, and the cool air formed by the evaporator circulates through the freezing chamber and the refrigerating chamber by the blower.

While the cool air circulates through the freezing chamber and the refrigerating chamber, the freezing chamber, the refrigerating chamber, and the vegetable chamber inside the refrigerating chamber maintain a preset temperature, respectively.

The refrigerator may be classified into various types according to a cool air circulation method, positions of the freezing chamber and the refrigerating chamber, a configuration of the evaporator, etc.

For instance, there are a refrigerator in which a freezing chamber is positioned above a refrigerating chamber, a refrigerator in which a freezing chamber and a refrigerating chamber are positioned side by side, a refrigerator in which a freezing chamber is positioned below a refrigerating chamber, etc.

The refrigerator is provided with various functions so as to meet a user's demands, and to enhance a user's convenience.

The refrigerator is equipped with an ice making system for making ice pieces.

The ice making system continuously makes ice pieces in the refrigerator, and includes an ice bank for storing ice pieces made in the refrigerator. A user may use the ice pieces by directly drawing out of the ice bank, or through a dispenser disposed on an outer surface of a refrigerator door.

The ice making system has been disclosed in U.S. Pat. No. 6,425,259 B2, and FIGS. 1 to 3 partially show the drawings of the U.S. patent.

According to the U.S. Pat. No. 6,425,259 B2, an icemaker 10 for making ice pieces is mounted to a refrigerator body 20 so as to be disposed in a freezing chamber. And, an ice bank 30 for storing ice pieces made by the icemaker 10 is coupled to an inner side of a refrigerator door 40 so as to be detachable in a vertical direction.

An ice crusher assembly 50 for crushing ice pieces is provided in the ice bank 30. And, a driving motor 60 for driving the ice crushing assembly 50, and a driving shaft 61 are vertically coupled to the refrigerator door 40. The ice crusher assembly 50 includes an ice crushing shaft 51, and a plurality of ice crushing cutters 52 coupled to the ice crushing shaft 51. The ice crushing shaft 51 of the ice crusher assembly 50 is coupled to the ice bank 30 so as to be positioned in a vertical direction. The ice bank 30 is mounted to the refrigerator door 40, such that a coupling part of the ice crushing shaft 51 is detachable from a coupling part of the driving shaft 61 in a vertical direction.

A dispenser 70 for dispensing crushed ice pieces stored in the ice bank 30 is provided on an outer surface of the refrigerator door 40.

Unexplained reference numerals 80 and 81 denote coupling parts for coupling the ice bank to the refrigerator door in a vertical direction.

However, the conventional system has the following systems.

Firstly, since the ice bank 30 is detachably mounted to the refrigerator door 40 in a vertical direction, a user has a difficulty in detaching the ice bank 30 from the refrigerator door 40. That is, the user has to align the coupling part of the ice crushing shaft 51 disposed on a lower surface of the ice bank 30, with the coupling part of the driving shaft 61 mounted to the refrigerator door 40. Furthermore, when the user has to lift up or lower the ice bank 30 in a vertical direction for detachable mounting, ice pieces stored in the ice bank 30 may be discharged out of the ice bank 30. The ice bank 30 is mounted to the refrigerator door 40 in a state that a rear surface of the ice bank 30 comes in contact with an inner wall of the refrigerator door 40. This may cause the ice bank 30 to be inclined by a predetermined angle when being mounted to the refrigerator door 40.

Besides, since the icemaker 10 is mounted to the refrigerator body 20 to be disposed in a freezing chamber, the freezing chamber is provided with a small space. This may degrade a spatial utilization degree of the freezing chamber.

SUMMARY OF THE INVENTION

Therefore, it is an object of the present invention to provide an ice making system for a refrigerator capable of facilitating detachment of an ice bank that stores ice pieces, capable of preventing the ice pieces stored in the ice bank from pouring when detaching the ice bank, and capable of enhancing a spatial utilization degree of a freezing chamber where ice pieces are made.

To achieve these and other advantages and in accordance with the purpose of the present invention, as embodied and broadly described herein, there is provided an ice making system for a refrigerator, comprising: a base member; an icemaker mounted to the base member for making ice pieces; a driving unit mounted to a rear surface of the base member so that a motor shaft thereof can be in a horizontal state; an ice bank horizontally inserted into the base member in a detachable manner, for storing the ice pieces made by the icemaker; a detachable mounting unit for detachably mounting the ice bank to the base member; and an ice crusher assembly provided at the ice bank so as to be connected to or separated from the driving unit, for crushing the ice pieces.

The ice making system according to the present invention has the following advantages.

Firstly, the ice bank can be easily coupled to or separated from the base member by being pushed into the base member for coupling in a horizontal direction, and by being pulled out of the base member for separation in a horizontal direction.

Secondly, since the ice bank is horizontally coupled to or separated from the base member, ice pieces stored in a storage space of the ice bank are prevented from being discharged out of the ice bank. If the ice bank is inclined when being separated from the base member, the ice pieces stored in the ice bank may be discharged out of the ice bank.

Thirdly, processes for fixing or releasing the ice bank to/from the base member are simplified. For fixation, the ice bank has only to be pushed in a sliding manner, thus to be locked to be fixed to pressing members of the detachable mounting unit. However, in order to release the fixed state of the ice bank to the base member, the pressing members of the detachable mounting unit are vertically pressed.

Fourthly, since the base member and the ice bank are mounted to the refrigerator door, a freezing chamber has a large space where ice pieces are made. This may enhance a spatial utilization degree of the freezing chamber.

Fifthly, first and second insertion-support portions provided on a rear surface of the ice bank are engaged with first and second supporting portions of the base member, thereby stably coupling the ice bank to the base member.

Sixthly, since a front surface of the ice bank is formed of a semi-transparent material, a user can check the amount of ice pieces stored in the storage space of the ice bank with his or her naked eyes. This may enhance the user's convenience.

BRIEF DESCRIPTION OF THE DRAWINGS

FIG. 1 is a sectional view showing an ice making system in accordance with the conventional art;

FIG. 2 is a perspective view showing an ice bank of the ice making system of FIG. 1;

FIG. 3 is a perspective view showing a coupling part to which the ice bank is coupled;

FIG. 4 is a perspective view showing an ice making system according to a first embodiment of the present invention;

FIG. 5 is a side view showing a mounted state of the ice making system according to a first embodiment of the present invention;

FIG. 6 is a perspective view showing a base member of the ice making system according to a first embodiment of the present invention;

FIG. 7 is a perspective view showing an ice bank of the ice making system according to a first embodiment of the present invention;

FIG. 8 is a side view showing a detachable mounting unit of the ice making system according to a first embodiment of the present invention;

FIG. 9 is a planar view showing an ice crusher assembly of the ice making system according to a first embodiment of the present invention;

FIG. 10 is a frontal view showing a first connection unit of the ice making system according to a first embodiment of the present invention;

FIG. 11 is a frontal view showing a second connection unit of the ice making system according to a first embodiment of the present invention;

FIGS. 12 and 13 are planar and frontal views showing a mode conversion assembly of the ice making system according to a first embodiment of the present invention; and FIG. 14 is an exploded perspective view showing the ice bank of the ice making system according to the present invention.

DETAILED DESCRIPTION OF THE EMBODIMENTS

Reference will now be made in detail to the preferred embodiments of the present invention, examples of which are illustrated in the accompanying drawings.

Hereinafter, an ice making system for a refrigerator according to the present invention will be explained in more detail with reference to the attached drawings.

FIG. 4 is a perspective view showing an ice making system according to a first embodiment of the present invention.

Referring to FIG. 4, the ice making system for a refrigerator comprises a base member 100 having a predetermined shape, an icemaker 200 mounted to the base member 100 for making ice pieces, and an ice bank 300 coupled to the base member 100 so as to be slidable in a horizontal direction.

Preferably, the icemaker 200 is disposed above the base member 100, and the ice bank 300 is disposed below the icemaker 200. As shown in FIG. 5, the base member 100 is mounted to an inner surface of a refrigerator door 90. The base member 100 may be mounted to a refrigerator body 20 so as to be disposed in a freezing chamber.

The ice bank 300 may be coupled to the base member 100 so as to be slidable in a horizontal direction in various manners, and one example thereof will be explained hereinafter.

Referring to FIG. 6, the base member 100 includes a vertical base portion 110 formed to have a predetermined area; a horizontal base portion 120 curvedly extending from a lower portion of the vertical base portion 110, and having a discharge opening 121 penetratingly formed therein, and a motor mounting portion 130 disposed at one side of a rear surface of the vertical base portion 110.

At the horizontal base portion 120, provided is a first supporting portion 122 for supporting the ice bank 300 by inserting the ice bank 300 into the base member 100 in a horizontal direction. The first supporting portion 122 is implemented as a guiding groove formed on an upper surface of the horizontal base portion 120 with a predetermined width and depth. And, stepped surfaces 123 are formed at both sides of the guiding groove. When the ice bank 300 is coupled to the base member 100, a lower portion of the ice bank 300 is partially inserted into the first supporting portion 122 in a sliding manner.

At the vertical base portion 110, provided is a second supporting portion for supporting the ice bank 300 by inserting the ice bank 300 into the base member 100 in a horizontal direction. The second supporting portion is composed of a left supporting portion 140 formed on a front surface of the horizontal base portion 120, and a right supporting portion 150 spacing from the left supporting portion 140.

The left supporting portion 140 is composed of a first protrusion 142 protruding from the vertical base portion 110 in a hexahedron shape and having a supporting surface 141 on an upper surface thereof, and a second protrusion 144 protruding from the supporting surface 141 of the first protrusion 142 with a step and having a supporting surface 143 on an upper surface thereof. The first protrusion 142 and the second protrusion 144 are formed to have stepped portions in a vertical direction.

The right supporting portion 150 is composed of a first protrusion 151 protruding from the vertical base portion 110 in a hexahedron shape, and a second protrusion 152 extending from the first protrusion 151 in a hexahedron shape. More concretely, the first protrusion 151 and the second protrusion 152 are protruding from the vertical base portion 110 in a horizontal direction. And, the first protrusion 151 has an area larger than that of the second protrusion 152.

Based on a front surface of the vertical base portion 110, the first protrusion 142 of the left supporting portion 140 has a height higher than that of the second protrusion 152 of the right supporting portion 150. And, the first protrusion 151 of the right supporting portion 150 has a height lower than that of the second protrusion 152 of the right supporting portion 150.

An inner side surface 145 of the first protrusion 142 of the left supporting portion 140 is disposed to face an inner side surface 153 of the first protrusion 151 of the right supporting portion 150. A distance between the inner side surface 145 of the first protrusion 142 of the left supporting portion 140 and the inner side surface 153 of the first protrusion 151 of the right supporting portion 150 is less than a width of the first supporting portion 122 of the horizontal base portion 120. And, the inner side surface 145 of the first protrusion 142 of the left supporting portion 140, and the inner side surface 153 of the first protrusion 151 of the right supporting portion 150 are disposed inside the first supporting portion 122 of the horizontal base portion 120, i.e., inside the guiding groove, respectively.

The inner side surface 154 of the second protrusion 152 of the right supporting portion 150, facing the inner side surface 145 of the first protrusion 142 of the left supporting portion 140 is disposed outside the first supporting portion 122 of the horizontal base portion 120, i.e., outside the guiding groove, respectively.

Preferably, a supporting protrusion 160 for preventing inclination of the ice bank 300 is extending from an upper portion of the vertical base portion 110 with a predetermined thickness and length.

Preferably, the icemaker 200 is mounted to an upper portion of the vertical base portion 110, and is mounted above the supporting protrusion 160.

The icemaker 200 has been well-known to those skilled in the art in various forms, and its detailed description will be omitted.

A driving unit 400 is mounted to a motor mounting portion 130 of the base member 100.

The driving unit 400 includes a motor 410 for generating a rotational force, and a first connection unit 420 connected to or separated from an ice crusher assembly. The ice crusher assembly is coupled to a motor shaft 411 of the motor 410 thus to be mounted in the ice bank 300, and serves to crush ice pieces. The first connection unit 420 may be implemented as a clutch, etc.

The motor shaft 411 is disposed in a horizontal direction, and is penetratingly inserted into the vertical base portion 110 of the base member 100. The first connection unit 420 is coupled to the end of the motor shaft 411 so as to be positioned on a front surface of the vertical base portion 110.

As shown in FIG. 7, the ice bank 300 is coupled to the first supporting portion 122 and the second supporting portion of the base member 100 so as to be slidable in a horizontal direction. The ice bank 300 is provided with a storage space for storing ice pieces therein, and is provided with, on a rear surface thereof, coupling parts to be coupled to the first and second supporting portions of the base member 100 in a sliding manner.

The ice bank 300 is formed such that lower portions of both sides of a rear surface thereof are concaved with a multi-step. More concretely, the left lower portion of the ice bank 300 is concaved with two-step, and the right lower portion thereof is concaved with two-step. Here, based on the rear surface of the ice bank 300, the left concaved portion by one step has a depth shallower than that of the right concaved portion by one step.

The right and left concaved portions of the rear surface of the ice bank 300 serve to form a first insertion-support portion 310 supported by being inserted into the first supporting portion 122 of the horizontal base portion 120, and a second insertion-support portion 320 supported by being inserted into the second supporting portion of the horizontal base portion 120.

The first insertion-support portion 310 includes stepped protrusions 311 formed at both sides of the rear surface of the ice bank 300 with steps from lower ends of the concaved portions by one step; and lower surfaces 312 of the stepped protrusions 311. The concaved portion by one step serves as a protruding surface by the concaved portion by two steps.

The second insertion-support portion 320 includes a stepped protrusion 321 relatively protruding as both sides of the rear surface of the ice bank 300 are respectively concaved by one step; and a right concaved portion by one step 322 formed as both sides of the ice bank 300 are respectively concaved by one step. The stepped protrusion 321 of the second insertion-support portion 320 has a rear surface that is the most protruding among rear surfaces of the ice bank.

When the ice bank 300 is coupled to the base member 100, the first insertion-support portion 310 and the second insertion-support portion 320 of the ice bank 300 are inserted into the first supporting portion 122 and the second supporting portion of the base member 100 in a sliding manner.

Once the ice bank 300 is inserted into the base member 100, the stepped protrusion 321 of the second insertion-support portion 320 is disposed between the inner side surface 145 of the first protrusion 142 of the left supporting portion 140, and the inner side surface 153 of the first protrusion 151 of the right supporting portion 150. And, both side surfaces of the stepped protrusion 321 come in contact with the inner side surfaces 145 and 153 of the first protrusions of the left and right supporting portions 140 and 150, respectively. The right concaved portion by one step 322 comes in contact with a front surface of the first protrusion 142 of the left supporting portion 140. An upper horizontal surface 323 of the right concaved portion by one step 322 comes in contact with the supporting surface 141 of the first protrusion 142 of the left supporting portion 140. And, the left concaved portion by one step 322 comes in contact with a front surface of the first protrusion 151 of the right supporting portion 150.

The stepped protrusion 311 of the first insertion-support portion 310 is disposed in the guiding groove, the first supporting portion 122 of the horizontal base portion 120. Both side surfaces of the stepped protrusion 311 come in contact with both side surfaces of the guiding groove, respectively, thus to be supported. And, a lower surface of the stepped protrusion 311 comes in contact with a lower surface of the guiding groove thus to be supported.

A rear surface hole 330 having a predetermined depth and a circular shape is formed on a rear surface of the ice bank 300, and a discharge opening (A) is formed on a bottom surface of the ice bank 300. When the ice bank 300 is inserted into the base member 100, the rear surface hole 330 is disposed to be concentric with the motor shaft 411. At the same time, the discharge opening (A) of the ice bank 300 becomes consistent with the discharge opening 121 of the base member 100.

An interference prevention groove 303 for preventing interference between the ice bank 300 and the icemaker 200 is provided at an upper portion on a rear surface of the ice bank 300.

Cut portions 304 cut in a predetermined shape are formed at both edges on the rear surface of the ice bank 300. The cut portions 304 serve as holes into which a user's fingers are inserted when coupling the ice bank 300 to the base member 100.

At the ice bank 300, or at both the ice bank 300 and the base member 100, formed is a detachable mounting unit 500 for coupling the ice bank 300 to the base member 100 when the ice bank 300 is inserted into the base member 100, or for releasing the fixed state of the ice bank 300 to the base member 100.

Preferably, the detachable mounting unit 500 is pressed by a user's hand in a vertical direction to fix the ice bank 300 to the base member 100, and the fixed state of ice bank 300 to the base member 100 is released as the user releases the pressed state of the detachable mounting unit 500.

As shown in FIG. 8, the detachable mounting unit 500 includes pressing members 510 coupled to the base member 100 so as to be movable in a vertical direction, an elastic member 520 for elastically supporting the pressing members 510, and hooks 305 disposed at the ice bank 300 and locked by one side of the pressing members 510.

The pressing members 510 include a guide portion 511 having a predetermined length, and a button portion 512 protruding from a side of one end of the guide portion 511. The button portion 512 is protruding in the same direction as the length direction of the guide portion 511, and is provided with an insertion hole 513 therein.

Preferably, the elastic member 520 is implemented as a compression coil spring.

Preferably, the detachable mounting unit 500 is disposed at both sides of the base member 100 and the ice bank 300, respectively.

Preferably, one pressing member 510 is coupled to the second protrusion 152 of the right supporting portion 150 of the base member 100, and another pressing member 510 is coupled to the second protrusion 144 of the left supporting portion 140 of the base member 100.

A first through hole is formed on an upper surface of the second protrusion 152 of the right supporting portion 150, and a second through hole is formed at the right stepped surface 123 of the horizontal base portion 120. The button portion 512 of the pressing members 510 is inserted into the second through hole to be protruded out. The end of the guide portion 511 is inserted into the first through hole to be protruded out. The elastic member 520 is inserted into the insertion hole 513 of the button portion 512 of the pressing members 510, and the elastic member 520 is supported by a supporting member 530 coupled to a lower surface of the base member 100. And, the pressing members 510 are supported by an elastic force of the elastic member 520.

A first through hole is formed on the supporting surface 143 of the second protrusion 144 of the left supporting portion 140, and a second through hole is formed at the left stepped surface 123 of the horizontal base portion 120. The button portion 512 of another pressing member 510 is inserted into the second through hole to be protruded out. The end of the guide portion 511 is inserted into the first through hole to be protruded out. The elastic member 520 is inserted into the insertion hole 513 of the button portion 512 of the pressing members 510, and the elastic member 520 is supported by the supporting member 530 coupled to a lower surface of the base member 100. And, the pressing members 510 are supported by an elastic force of the elastic member 520.

Preferably, grooves 514 are formed at both side surfaces of the guide portion 511 of the pressing members 510, and a guide protrusion 101 to be inserted into the grove is formed at one side of the base member 100. Preferably, when the pressing members 510 are moved in a vertical direction, the guide protrusion 101 guides the motion of the pressing members 510.

Hooks 305 are protruding from both sides of the ice bank 300 with a predetermined shape, and are locked by the end of the guide portion 511 of the pressing members 510. The two hooks 305 are disposed to be locked by each end of the guide portions 511 of the pressing members 510 coupled to the base member 100.

The hooks 305 of the ice bank 300 may be implemented as protrusions protruded to be locked by the end of the guide portion 511, or may be implemented as grooves.

When the ice bank 300 is coupled to the base member 100 by sliding in a horizontal direction, the hooks 305 disposed at both sides of the ice bank 300 press, in a pushing manner, each end of the guide portions 511 of the pressing members 510 protruding from both sides of the base member 100. Accordingly, the hooks 305 are locked by each end of the guide portions 511 of the pressing members 510. Since the pressing members 510 are supported by the elastic member 520, they are pushed in a vertical direction thus to be immediately moved to the original positions In order to detach the ice bank 300 from the base member 100, the button portion 512 of the pressing members 510 is downwardly pressed. As the pressing members 510 are downwardly moved, the hooks 305 of the ice bank 300 locked by each end of the guide portions 511 of the pressing members 510 are released. At this moment, the ice bank 300 is detached from the base member 100 in a horizontal direction. When the pressed state of the button portion 512 is released, the pressing members 510 are upwardly moved by an elastic force of the elastic member 520 thus to return to the original positions.

An ice crusher assembly for crushing ice pieces is provided at the ice bank 300.

Referring to FIG. 9, the ice crusher assembly includes a rotation shaft 610 rotatably inserted into a lower portion of the ice bank 300, a transfer unit 620 mounted to one side of the rotation shaft 610 for transferring ice pieces, an ice crushing unit 630 mounted to the rotation shaft 610 with a predetermined gap from the transfer unit 620 for crushing ice pieces, and a second connection unit 640 coupled to the end of the rotation shaft 610 and connected to or separated from the first connection unit 420 of the driving unit 400.

The transfer unit 620 includes a screw 621 formed in a spiral shape and transferring ice pieces by being rotated, and a fixing unit 622 for fixing the screw 621 to the rotation shaft 610.

The ice crushing unit 630 includes a fixed cutter 631, a plurality of rotatable cutters 632, and spacers 633 disposed between the fixed cutter 631 and the rotatable cutters 632.

A lower portion of the ice bank 300 is divided into two spaces by a partition wall (E). One space is a storage space (C1) for storing ice pieces, and another space is an ice crushing space (C2) for crushing ice pieces. A discharge opening (not shown) is provided at the bottom of the ice crushing space (C2). At the partition wall (E), formed is a transfer hole (e1) through which the ice pieces inside the storage space (C1) are transferred to the ice crushing space (C2). At one side of the transfer hole (e1), formed is a shaft supporting groove (e2) for supporting the rotation shaft 610.

The rotation shaft 610 is penetratingly coupled to the ice bank 300 in a horizontal direction. Here, one end of the rotation shaft 610 is rotatably supported by a rotation supporting portion 301 formed on a front surface of the storage space (C1) of the ice bank 300, and is supported by the shaft supporting groove (e2) of the partition wall (E). And, another end of the rotation shaft 610 is penetratingly formed at a rear surface of the ice bank 300, and is provided with the second connection unit 640.

The second connection unit coupled to the end of the rotation shaft 610 is connected to the first connection unit of the driving unit when the ice bank 300 is inserted into the base member 100.

Referring to FIG. 10, the first connection unit 420 includes a connection body 421 having hook portions 421*b* curvedly extending from both ends of a coupling body portion 421*a* coupled to the end of the motor shaft 411 of the driving unit 400, and a fixing member 422 for fixing the connection body 421 to the motor shaft 411. Here, each end of the hook portions 421*b* is formed in a triangular shape.

Referring to FIG. 11, the second connection unit 640 includes a cylindrical body 641 having two hook protrusions 641*b* protruding from an inner wall of a cylindrical body portion 641*a* in a triangular shape, and a fixing member 642 for fixing the cylindrical body 641 to the rotation shaft 610.

When the first connection unit 420 is to be coupled to the second connection unit 640 in a horizontal direction, the hook portions 421*b* of the first connection unit 420 are locked by the hook protrusions 641*b* of the second connection unit 640. On the contrary, when the first connection unit 420 is to be separated from the second connection unit 640, the second connection unit 640 has only to be separated from the first connection unit 420 in a horizontal direction. As side surfaces of the hook portions 421*b* are locked by side surfaces of the hook protrusions 641*b* thus to be rotated, the rotation force of the first connection unit 420 is transmitted to the second connection unit 640.

As the rotation force generated from the driving unit 400 is transmitted to the second connection unit 640 via the first connection unit 420, the rotation shaft 610 of the ice crusher assembly is rotated. As the rotation shaft 610 is rotated, ice pieces stored in the storage space (C1) of the ice bank 300 are crushed by the ice crushing unit 630 while being transferred to the ice crushing space (C2) by the transfer unit 620.

The transfer unit 620 is located below the storage space (C1) of the ice bank 300, and the ice crushing unit 630 is located in the ice crushing space (C2).

The ice bank 300 is provided with a mode conversion assembly.

The mode conversion assembly controls the ice pieces stored in the storage space (C1) of the ice bank 300 to be directly discharged out through a discharge opening by controlling the size of the transfer hole (e1) of the partition wall (E) of the ice bank 300. Alternatively, the mode conversion assembly controls the ice pieces to be discharged out through the discharge opening by crushing the ice pieces.

More concretely, when the mode conversion assembly blocks a part of the transfer hole (e1), the ice pieces are crushed by the ice crushing unit 630. However, when the mode conversion assembly does not block the transfer hole (e1), the ice pieces are not crushed, but are directly discharged to the discharge opening.

The mode conversion assembly may be implemented in various manners. As shown in FIGS. 6, 12 and 13, the mode conversion assembly includes an actuator (insulator) 710 mounted to the base member 100, a ring-shaped portion 720 connected to the actuator 710, a blade guide 730 disposed at the ice bank 300 for controlling the size of the transfer hole (e1), and a lever unit 740 for connecting the blade guide 730 and the ring-shaped portion 720 to each other.

A through hole 102 having a predetermined size is formed at one side of the base member 100, and the ring-shaped portion 720 is located in the through hole 102.

Preferably, the through hole 102 having the ring-shaped portion 720 therein is formed at one side of a front surface of the first protrusion 151 of the right supporting portion 150 of the base member 100 in a square shape. And, the ring-shaped portion 720 is located on a rear surface of the base member 100.

A through hole 302 is formed at one side of the right concaved portion by one step 322 of the second insertion-support portion 320 of the ice bank 300. And, one side of the lever unit 740 is protruding from the through hole 302.

When the ice bank 300 is inserted into the base member 100, a part of the lever unit 740 is located in the ring-shaped portion 720.

In a state that the ice bank 300 has been inserted into the base member 100, when the actuator 710 is operated, the ring-shaped portion 720 connected to the actuator 710 is vertically moved, thereby vertically moving a part of the lever unit 740 located in the ring-shaped portion 720. As the lever unit 740 is vertically moved, the blade guide 730 performs an angular-motion to control the size of the transfer hole (e1). When the blade guide 730 does not block the transfer hole (e1), the ice pieces stored in the storage space (C1) are not crushed, but are directly discharged to the discharge opening. However, when the blade guide 730 blocks the transfer hole (e1), the ice pieces are crushed by the ice crushing unit 630 to be discharged to the discharge opening.

The ice bank 300 may be formed as a plurality of components are assembled to each other.

As shown in FIG. 14, the ice bank 300 may include a front bucket 340 that forms a part of a lower surface and a front surface of the ice bank 300, a window tray 350 coupled to the front bucket 340 and forming a front surface of the ice bank 300 together with the front bucket 340, a rear bucket 360 coupled to the front bucket 340 and forming an inner space to store ice pieces together with the window tray 350 and the front bucket 340, a blade cover 370 coupled to a lower portion of the rear bucket 360 and forming an inner space, and a bucket cover 380 coupled to the rear bucket 360 for covering the blade cover 370.

The front bucket 340 includes a front surface portion 341 formed as a rectangular plate is curved to have three surfaces, and having an opening concavely formed at an upper portion thereof; and cut portions 304 cut in a predetermined shape at lower portions of both side surfaces of the front surface portion 341. A curved surface portion 342 is extending from an inner surface of the front surface portion 341 in a rounded shape with a predetermined thickness and area. And, a plurality of protrusion ribs are protruding from a lower surface of the curved surface portion 342 so as to cross each other. The protrusion ribs 343 of the front bucket 340 constitute a part of the bottom surface of the ice bank 300. And, a plurality of coupling portions 344 are formed at the edge of the front surface portion 341 and on a lower surface of the curved surface portion 342.

The window tray 350 includes a curved plate portion 351 formed as a plate having a predetermined shape is curved so as to have three surfaces in correspondence to the front surface portion 341 of the front bucket 340, and a coupling portion 352 formed at the edge of the curved plate portion 351 and coupled to the front bucket 340. Preferably, the window tray 350 is formed of a semi-transparent material, and is provided with a coating film for prevention of corrosion on an inner surface thereof.

The window tray 350 is coupled to the front bucket 340 so as to cover a front opening of the front bucket 340.

The rear bucket 360 includes a curved portion 361 curved so as to have a predetermined inner space; a lower plate portion 362 extending from a lower portion of the curved portion 361 so as to have a predetermined area, and having the transfer hole (e1) and the shaft supporting groove (e2) therein; and a plurality of coupling portions formed at the curved portion 361 and the lower plate portion 362. The rear bucket 360 has a size corresponding to that of the front bucket 340.

The rear bucket 360 is coupled to a rear surface of the front bucket 340. Here, the transfer hole (e1) of the rear bucket 360 is located in the curved surface portion 342 of the front bucket 340.

The window tray 350, the front bucket 340, and the rear bucket 360 define the storage space (C1) for storing ice pieces.

The blade cover 370 includes a rear plate portion 371 having a predetermined area and provided with a through hole therein, and side portions 372 curvedly extending from both edges of the rear plate portion 371 so as to have predetermined areas. A A mounting portion 373 for mounting the mode conversion assembly is provided at one of the side portions 372, and a plurality of coupling portions are coupled to each of the side portions 372.

The blade cover 370 is coupled to a rear surface of the lower plate portion 362 of the rear bucket 360, and the ends of the side portions 372 come in contact with the rear surface of the lower plate portion 362. Here, an upper opening of the blade cover 370 is covered by a lower surface of the curved portion 361 of the rear bucket 360. And, a lower opening of the blade cover 370 constitutes the discharge opening (A). The blade cover 370, and the lower plate portion 362 of the rear bucket 360 define an ice crushing space therein.

The bucket cover 380 includes a cover portion 381 formed in a multi-step so as to have an inner space, and having a through hole penetratingly formed at the center thereof; a ring-shaped portion 382 curvedly extending from the edge of the through hole so as to have a predetermined width; and a plurality of coupling portions 383 formed at the edge of the cover portion 381. A lower portion of the cover portion 381 is opened to serve as a discharge opening.

The bucket cover 380 is coupled to a rear surface of the lower plate portion 362 of the rear bucket 360. Here, the ring-shaped portion 382 of the bucket cover 380 becomes consistent with the through hole of the blade cover 370 coupled to the rear bucket 360. As the lower opening of the blade cover 370 overlaps a lower opening of the bucket cover 380, a discharge opening is formed.

The front bucket 340, the rear bucket 360, and the bucket cover 380 define a rear surface of the ice bank 300.

The hooks 305 formed on a rear surface of the ice bank 300 may be provided at the rear bucket 360 or the bucket cover 380.

An ice making system for a refrigerator according to a second embodiment comprises: a base member; an icemaker mounted to a front surface of the base member for making ice pieces; an ice bank horizontally inserted into the base member in a detachable manner, for storing the ice pieces made by the icemaker; and a detachable mounting unit for detachably mounting the ice bank to the base member.

The ice making system for a refrigerator according to the second embodiment is implemented by excluding the mode conversion assembly, the ice crusher assembly, and the driving unit from the ice making system for a refrigerator according to the first embodiment, and its detailed explanation will be omitted.

The base member, the icemaker, the ice bank, and the detachable mounting unit of the second embodiment have the same configurations as those of the first embodiment, except that the ice bank is not provided with a ice crushing space and a discharge opening.

Hereinafter, the operation of the ice making system for a refrigerator according to the present invention will be explained.

Firstly, the operation of the ice making system for a refrigerator according to the first embodiment of present invention will be explained.

In a state that the icemaker 200 has been mounted to the base member 100, the base member 100 is fixedly coupled to an inner wall of the refrigerator door 90. The base member 100 may be fixedly coupled to the refrigerator body so as to be located in the freezing chamber. Hereinafter, a case that the base member 100 is coupled to the refrigerator door 90 will be explained.

In a state that the base member 100 is fixedly coupled to the inner wall of the refrigerator door 90, the vertical base portion 110 is disposed in a vertical direction, and a rear surface of the vertical base portion 110 is disposed to face an inner surface of the refrigerator door 90. And, the horizontal base portion 120 of the base member 100 is disposed in a horizontal direction.

Here, the driving unit 400 mounted to the vertical base portion 110 of the base member 100 is disposed in a horizontal direction of the motor shaft 411.

The pressing members 510 of the detachable mounting unit 500 provided at the base member 100 are protruded out by the elastic member 520.

In this state, the ice bank 300 for storing ice pieces is insertion-coupled to the base member 100 in a horizontal direction.

In order to couple the ice bank 300 to the base member 100, a lower surface of the ice bank 300 is located on a lower surface of the first supporting portion 122 of the base member 100, and the ice bank 300 is pushed in a horizontal direction. Then, while the ice bank 300 performs a sliding motion in a horizontal direction, the first insertion-support portion 310 and the second insertion-support portion 320 of the ice bank 300 are engaged with the first supporting portion 122 and the second supporting portion of the base member 100, respectively. As a result, the ice bank 300 is coupled to the base member 100. As the ice bank 300 performs a sliding motion, the hooks 305 of the ice bank 300 are locked by the end of the pressing members 510 of the detachable mounting unit 500 thus to be fixed.

Here, the lever unit 740 of the mode conversion assembly provided at the ice bank 300 is partially located in the ring-shaped portion 720, and the second connection unit 640 of the ice crusher assembly is connected to the first connection unit 420 provided at the base member 100.

In a state that the ice bank 300 has been mounted to the base member 100, the icemaker 200 starts to make ice pieces. The ice pieces are made to drop into the ice bank 300, thereby being stored in the storage space (C1) of the ice bank 300. Once the ice pieces are filled in the storage space (C1) of the ice bank 300 by a preset amount, the icemaker 200 stops making ice pieces, thereby stopping the ice pieces from dropping into the ice bank 300.

When a user is to discharge the ice pieces stored in the storage space (C1) of the ice bank 300, the driving unit 400 is operated in a state that the blade guide 730 of the mode conversion assembly completely opens the transfer hole (e1) of the partition wall. As the driving unit 400 is operated, the rotation force of the driving unit 400 is transmitted to the rotation shaft 610 of the ice crushing assembly via the first connection unit 420 and the second connection unit 640. As the rotation shaft 610 is rotated, the ice pieces stored in the storage space (C1) are transferred by the transfer unit 620 thus to drop through the transfer hole (e1) and the discharge opening (A) 121.

When the user is to crush the ice pieces stored in the storage space (C1) of the ice bank 300, the blade guide 730 of the mode conversion assembly partially blocks the transfer hole (e1) of the partition wall. As the transfer hole (e1) is partially blocked, the ice pieces being transferred to the transfer hole (e1) are crushed by the ice crushing unit 630 of the ice crusher assembly, thus to drop through the discharge opening (A) 121.

When the user is to utilize the ice pieces stored in the storage space (C1) of the ice bank 300 by discharging out them, the user puts his or her both hands into the cut portions 304 disposed at both sides of the ice bank 300. Then, the user presses the button portion 512 of the pressing members 510 of the detachable mounting unit 500. As the user presses the button portion 512 of the pressing members 510, the pressing members 510 are downwardly moved. At this time, the locked state of the hooks 305 of the ice bank 300 is released, and the user pulls the ice bank in a horizontal direction with holding both side ends of the ice bank 300. As the user pulls the ice bank 300 in a horizontal direction, the ice bank 300 is separated from the base member 100 with horizontally moving.

In order to couple the ice bank 300 to the base member 100, the ice bank 300 is pushed into the base member 100.

In the second embodiment of the present invention, the user can utilize the ice pieces made by the icemaker 200 and stored in the storage space (C1) of the ice bank 300 by separating the ice bank 300 from the base member 100. The processes for coupling or separating the ice bank 300 to/from the base member 100 are the same as those of the aforementioned embodiment.

The ice making system for a refrigerator according to the present invention has the following advantages.

Firstly, the ice bank 300 has only to be horizontally pushed into the base member 100 for coupling, or horizontally pulled out of the base member 100 for separation, the processes for coupling or separating the ice bank 300 to/from the base member 100 are facilitated.

Secondly, since the ice bank 300 is coupled to or separated from the base member 100 in a horizontal direction, the ice pieces stored in the storage space (C1) of the ice bank 300 are prevented from being discharged out of the ice bank 300. If the ice bank 300 is inclined when being separated from the base member 100, the ice pieces stored in the ice bank 300 may be discharged out of the ice bank 300.

Thirdly, processes for fixing or releasing the ice bank 300 to/from the base member 100 are facilitated. For fixation, the ice bank 300 has only to be pushed into the base member 100 in a sliding manner, thus to be locked to be fixed to the pressing members 510 of the detachable mounting unit 500. However, in order to release the fixed state of the ice bank 300 to the base member 100, the pressing members 510 of the detachable mounting unit 500 are pressed in a vertical direction.

Fourthly, since the base member 100 and the ice bank 300 are mounted to the refrigerator door, a freezing chamber has a large space where ice pieces are made. This may enhance a spatial utilization degree of the freezing chamber.

Fifthly, the first and second insertion-support portions 310 and 320 provided on a rear surface of the ice bank 300 are engaged with the first supporting portion 122 and the second supporting portion of the base member 100, thereby stably coupling the ice bank 300 to the base member 100.

Sixthly, since a front surface of the ice bank 300 is formed of a semi-transparent material, the user can check the amount of the ice pieces stored in the storage space of the ice bank 300 with his or her naked eyes. This may enhance the user's convenience.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. An ice bank detachably mounted on a base member located at a refrigerator door, the ice bank comprising:

a front wall, a rear wall, opposite side walls and a bottom wall, wherein the front wall, the rear wall, the opposite side walls and the bottom wall define an ice storage space having a top opening;

a blade cover coupled to the rear wall, wherein the rear wall and the blade cover define an ice crushing space;

a rotation shaft extended through the blade cover and the rear wall;

a transfer unit coupled to the rotation shaft and disposed within the ice storage space;

an ice crushing unit coupled to the rotation shaft and disposed within the ice crushing space;

an ice transfer hole provided at the rear wall such that ices are transferred from the ice storage space to the ice crushing space through the ice transfer hole by the transfer unit; and a shaft supporting groove supporting the rotation shaft and communicated with the ice transfer hole.

2. The ice bank of claim 1, wherein the rear wall comprises:

an upper portion of the rear wall having an inclined surface; and a lower portion of the rear wall vertically extending from the upper portion of the rear wall and positioned forward the upper portion of the rear wall, the lower portion being coupled to the blade cover so as to define the ice crushing space.

3. The ice bank of claim 2, wherein the ice crushing space is separated from the ice storage space by the lower portion of the rear wall, and wherein the ice crushing unit is disposed within the ice crushing space to selectively crush the ices.

4. The ice bank of claim 3, wherein the ice transfer hole is formed on the lower portion of the rear wall, and wherein the shaft supporting groove is formed on one side of the ice transfer hole.

5. The ice bank of claim 4, further comprising a motor connected to the ice crushing unit and generating a rotational force to operate the ice crushing unit.

6. The ice bank of claim 4, wherein the rotation shaft passes through the rear wall to be placed at the ice storage space and the ice crushing space, wherein the transfer unit is coupled to a part of the rotation shaft in the ice storage space, and wherein the ice crushing unit is coupled to another part of the rotation shaft in the ice crushing space.

7. The ice bank of claim 2, wherein the lower portion of the rear wall is coupled to an inner portion of the front wall.

8. The ice bank of claim 2, wherein the blade cover comprises:

a rear plate portion defining a rear surface of the ice bank; and side portions curvedly extending from opposite edges of the rear plate portion toward the rear wall so as to define the ice crushing space.

* * * * *